United States Patent [19]

Bolton

[11] Patent Number: 4,493,684

Date of Patent: Jan. 15, 1985

[54] METHOD FOR MAKING PARTIALLY SEPARATED MULTIBAGS

[75] Inventor: Roderick A. Bolton, Clarkson, Canada

[73] Assignee: W. R. Grace & Co., Cryovac Div., Duncan, S.C.

[21] Appl. No.: 511,696

[22] Filed: Jul. 7, 1983

[30] Foreign Application Priority Data

Oct. 4, 1982 [CA] Canada ..... 412722

[51] Int. Cl.[3] ..... B65B 43/04

[52] U.S. Cl. ..... 493/234; 53/459; 53/570; 225/100

[58] Field of Search ..... 225/100, 106; 493/234; 53/459, 384–386, 570

[56] References Cited

U.S. PATENT DOCUMENTS

| | | | |
|---|---|---|---|
| 2,874,886 | 2/1959 | Diayye | 225/106 |
| 3,161,347 | 12/1964 | Hannon . | |
| 3,298,580 | 1/1967 | Lerner | 225/106 |
| 3,331,182 | 7/1967 | Hannon . | |
| 3,579,948 | 5/1971 | Lerner | 53/459 |
| 3,587,843 | 6/1971 | Wing . | |
| 3,754,370 | 8/1973 | Hauson | 225/100 X |
| 4,334,399 | 6/1982 | Onishi | 53/459 X |

*Primary Examiner*—David Simmons

*Attorney, Agent, or Firm*—John J. Toney; William D. Lee, Jr.; Joseph P. Harps

[57] ABSTRACT

There is provided a method for making a supply of partially separated multibag units, comprising first passing a perforated chain of side-sealed bags through a first set of driven nip rollers, then passing said chain directly to a second set of nip rollers having a partial nip of selected width less than the width of said chain, while driving said second nip rollers at a speed greater than said first nip rollers sufficient to partially separate the bags at their respective lines of perforation, and while cyclically completing the nip of said second nip rollers at predetermined intervals corresponding to the number of bags desired in each multibag unit. Associated apparatus for making said partially separated multibag units is also provided.

9 Claims, 5 Drawing Figures

METHOD FOR MAKING PARTIALLY SEPARATED MULTIBAGS

BACKGROUND OF THE INVENTION

This invention relates generally to manufacture of plastic packaging bags. More particularly, this invention relates to separating and partially separating bags within a perforated chain of bags.

In the field of packaging articles such as food products, it is known to load the products into plastic bags, and then to seal the bag openings, respectively. It is also known to carry out the sealing operation in a vacuum chamber where the residual atmosphere within the bag can be withdrawn and the package sealed under vacuum conditions in order to avoid deterioration of the food product in the sealed bag.

It is known to load product articles into packaging bags, made of flexible heat shrinkable film material, by supplying bags to a bag loader, in the form of a continuous chain of discrete bags carried releasably on adhesively-coated support tapes. Articles to be packaged are situated at a loading station typically by feeding on a conveyor belt into a guide from which the article is loaded into the leading bag of the chain, after opening of the bag for example by an inflation air jet. The bag loader accepts the bags in shingled or imbricated configuration, and it is then left up to either the operator or some article-advancing means, to remove the top loaded bag from the imbricated bag chain before the next successive bag can be inflated and loaded. Supplying the bags in imbricated configuration in a taped chain offers considerable advantages over supplying the bags one at a time to the loading equipment.

The present invention aims to provide means for making a packaging system which is capable of more rapid and economic operation for loading articles into bags which are fed to a loading station in the form of a sequence of bags. Such system is intended to enable the packaging operation to be speeded up in subsequent vacuumizing and sealing steps as well.

U.S. Pat. Nos. 3,161,347 and 3,331,182 disclose of typical bag loading processes and apparatus and illustrate the use of a chain of bags in imbricated form supported on a continuous support member so that the imbricated bags arrive at a loading station where the uppermost bag is pneumatically inflated and has a product article placed therein, after which the bag is removed from its elongate support member and delivered ready for subsequent advance to a bag closing station.

U.S. Pat. No. 3,587,843 discloses a package of such bags supported on two adhesively coated tapes to which the bags are releasably attached. The manufacture of such a package of taped bags requires initially the production of a plurality of separate bags, then the shingling of those bags on a moving delivery conveyor accompanied by superimposition and pressure adhesion of the tapes thereto after which the taped bag supply can be packaged either by being wound up on a support roll or layered into a box. The package of bags, either on a support roll or in a box, or on or in any other suitable holder, can then be transported to a user location where the individual bags will be filled by a bag loader to which the bags are fed as a chain of imbricated bags.

Of general interest is the disclosure of U.K. patent application No. 2,078,654A for "Loading Plastic Bags for Packaging Purposes" published Jan. 13, 1982, directed to a packaging process that utilizes a chain of side-sealed packaging bags with the mouths of the bags facing laterally of the chain of bags. Several of the bags are loaded in a batch, and the bags are subsequently closed in batch-wise fashion.

Of general interest is the disclosure of U.K. patent application No. 2,080,179A for "Apparatus for Separating and Loading Bags of a Chain of Side-Sealed Packaging Bags" published Feb. 3, 1982, directed to a mechanism for separating and loading bags from a perforated chain of side-sealed laterally extending packaging bags, especially in connection with the preceding cited packaging process.

SUMMARY OF THE INVENTION

The present invention is directed to a method of making a series of multiple-bag units adapted for imbrication on a carrier. Such multibag units may each be handled essentially as a single bag upon sequential presentation to a bag loader, thereby multipying output from the loader. This handling advantage is also realized in subsequent vacuumizing and sealing operations, further enhancing productivity.

Accordingly, there is provided a method for making a supply of partially separated mutlibag units, comprising first passing a perforated chain of side-sealed bags through a first set of driven nip rollers, then passing said chain directly to a second set of nip rollers having a partial nip of selected width less than the width of said chain, while driving said second nip rollers at a speed greater than said first nip rollers sufficient to partially separate the bags at their respective lines of perforation, and while cyclically completing the nip of said second nip rollers at predetermined intervals corresponding to the number of bags desired in each multibag unit. Preferably, partial separation of the bags within a multibag unit is symmetric with respect to the bag length.

Also, there is provided apparatus for making a supply of partially separated multibag units, comprising means for passing a perforated chain of side-sealed bags through a first set of driven nip rollers; means for passing said chain directly to a second set of nip rollers, having a partial nip of selected width less than the width of said chain; means for driving said second nip rollers at a speed greater than said first nip rollers sufficient to partially separate the bags at their respective lines of perforation; and means for cyclically completing the nip of said second nip rollers at predetermined intervals corresponding to the number of bags desired in each multibag unit.

BRIEF DESCRIPTION OF THE DRAWINGS

Further details are given below with reference to the embodiments shown in the drawings wherein.

DESCRIPTION OF THE PREFERRED EMBODIMENTS

Figure 1:
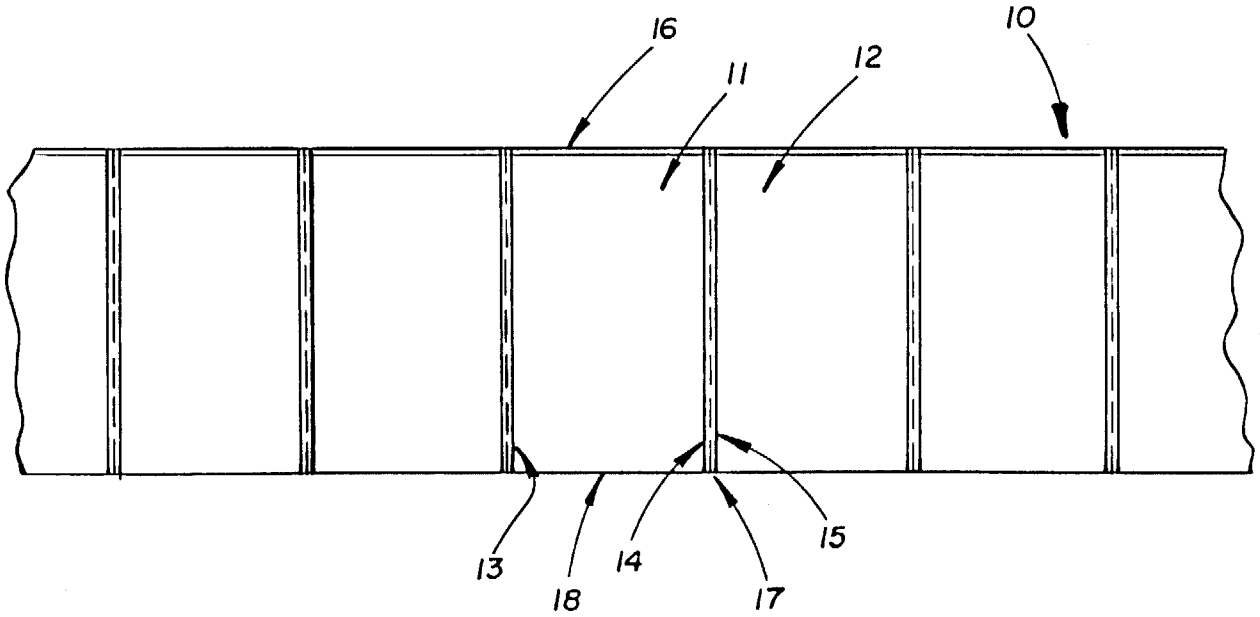
FIG. 1 shows a conventional perforated series of side-sealed bags which are fed to separator apparatus of the invention.

Referring specifically to the drawings, in FIG. 1 a conventional series 10 of perforated side-sealed plastic bags is shown, for example being of indefinite length and made of polyethylene. Bags within the series, such as bags 11 and 12, are separated by a line of perforation 17, with side-seals 14 and 15 on either side of perforation 17. Bag 11, for example, is defined by side-seals 13 and 14, fold line 18 and extended lip opening 16. Such a series of bags may be made by conventional techniques, for example, first extruding a plastic tube, then collapsing said tube to a lay-flat configuration possibly following orientation, cutting along one fold line to form an extended lip opening, and repeatedly forming transverse seals, such as by impulse welding, and lines of perforation at regular intervals along the collapsed tube to create a series of side-sealed bags which open laterally and which are separated by transverse lines of perforation. Such a series of side-sealed bags is the starting material for utilization of the present invention.

Figure 2B:
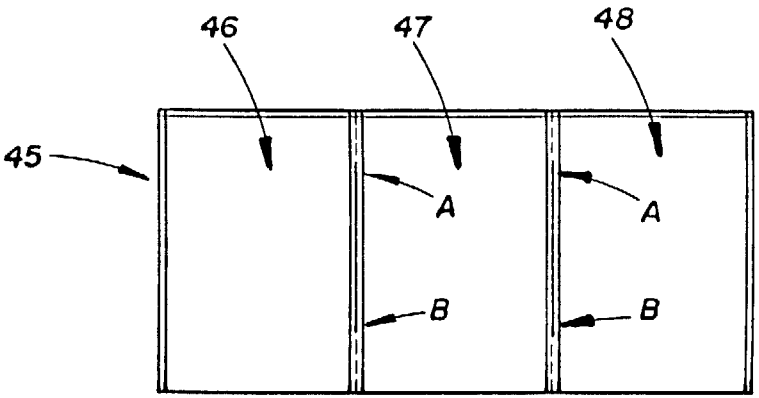
FIGS. 2A,B show representative multibag units having two and three component bags, respectively.
Figure 2A:
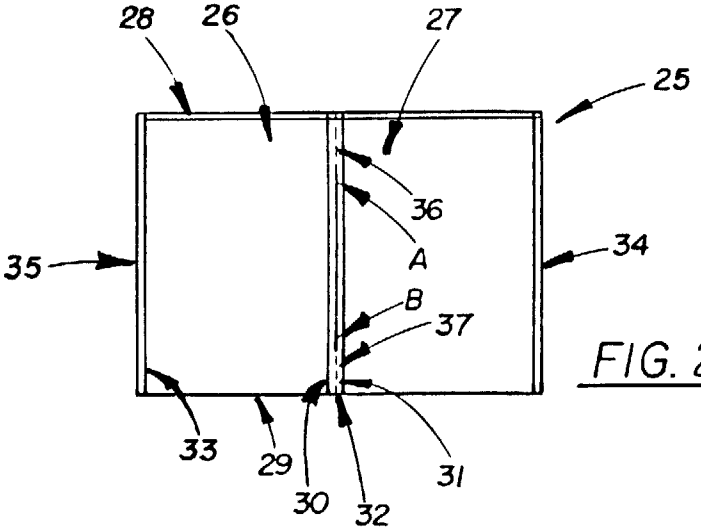

In FIGS. 2A and 2B, there are shown representative examples of multibag units, for definitional purposes. In FIG. 2A, there is shown a two bag multibag unit 25, having component bags 26 and 27 which have been jointly separated from a chain of perforated side-sealed bags at separated lines of perforation 34 and 35. Bag 26, for example, is as discussed above having extended lip opening 28, fold 29, and side-seals 30 and 33. At the junction between the two bags making up the multibag unit there are side-seals 30 and 31 juxtaposed about line of perforation 32. Line of perforation 32, however, is partially separated as indicated between points A and B. Preferably, partial separation between bags within a multibag unit is symmetrical with respect to the length of the bags as shows. Optionally, the partial separation may be asymmetric even to the extent that partial separation begins at an edge of the multibag unit. Thus, in the example shown, bags 26 and 27 are held together by perforation segments 36 and 37 to unify the multibag unit. In FIG. 2B, there is shown a three bag multibag unit 45, having component bags 46, 47 and 48. Individual bags within unit 45 have been partially separated along their respective lines of perforation as indicated by segments AB as discussed in connection with FIG. 2A. Using the method and apparatus of the invention, multibag units of any number of bags may be made. As stated above, the bags are used preferably by longitudinally imbricating on carrier tape so that a series of such taped multibags may be fed to a conventional taped bag loader with the advantage that a multibag unit may be handled during loading, vacuumizing and sealing essentially as a single bag, thereby correspondingly multiplying output from the packaging operation. Optionally, the sealing operation may include trimming off excess material beyone the outermost seals of each unit. Following sealing of the loaded bags, the individual bags within a unit may be easily separated due to the preexisting partial separation along the lines of perforation delimiting the bags within the multibag unit.

Figure 3:
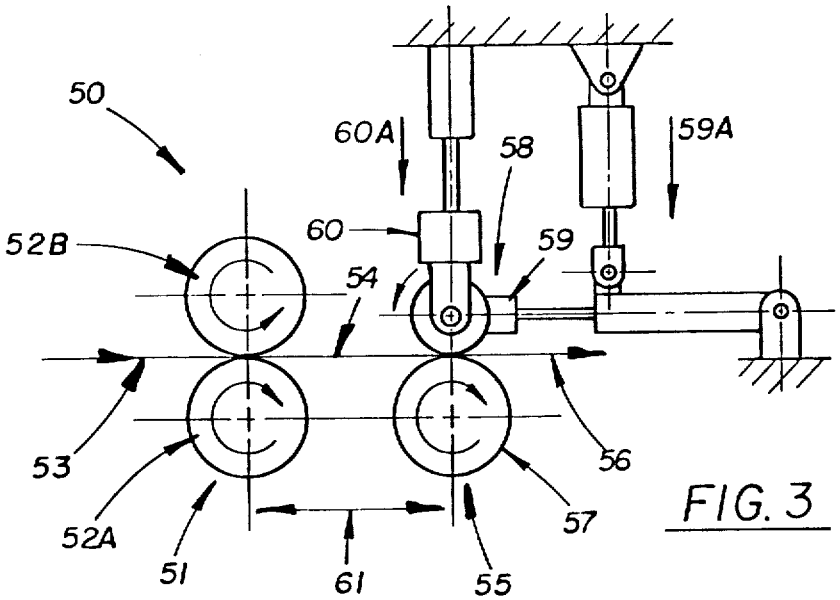
FIG. 3 shows a side view of an embodiment of separator apparatus of the invention.

In FIG. 3, there is shown a side view of a preferred embodiment of the apparatus of the invention, hereinafter referred to as separator 50. Separator 50 has a first set of nip rollers 51 driven in counter-rotating fashion. A feed chain of bags, as discussed in connection with FIG. 1, is indicated at 53 as being carried through the nip of roller set 51 having rollers 52A,B being in nipping contact with said feed chain 53. The chain of bags is propelled forward as shown at 54 from the nip of first roller set 51 into the nip of a second roll set 55 having bottom roller 57 driven so as to propel the chain of bags forward, as shown at 56. First roll set 51 and second roll set 55 are selectively spaced apart as shown at 61. Roll set 55 is driven at a speed faster than roll set 51 so that tension is exerted along the chain of bags across span 61 and therefore on the lines of perforation between the bags within the chain, respectively. Cooperating with bottom roll 57 in roll set 55 is separator mechanism 58.

Figure 4:
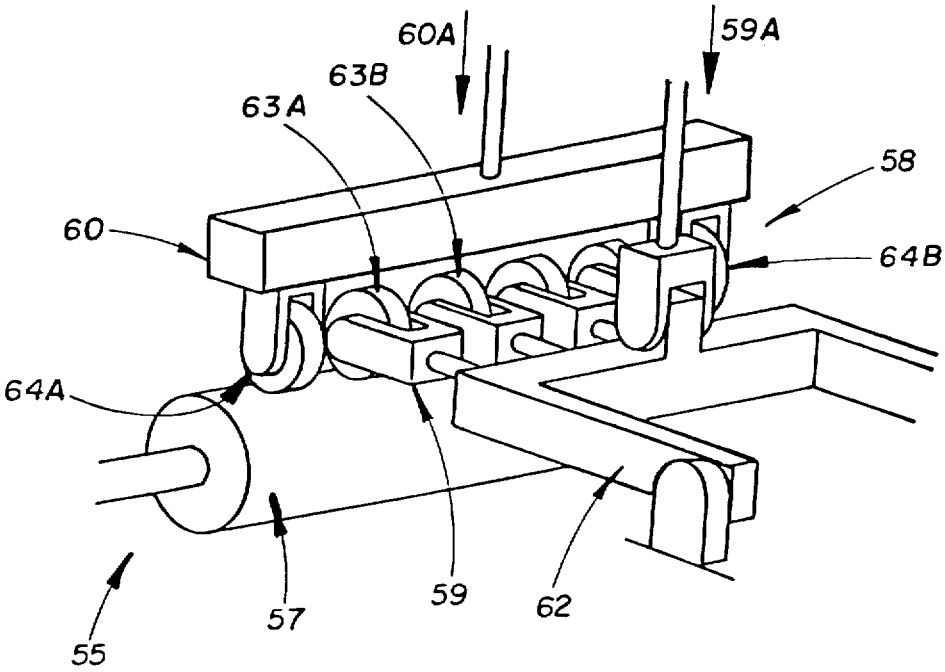
FIG. 4 shows a detailed perspective view of the second roll set of the foregoing separator apparatus.

In FIG. 4, a detailed perspective view is shown of roll set 55 and in particular separator mechanism 58. Downward pressure is exerted as indicated at arrow 59A on partial separator mechanism 59 having pivot arm 62 supporting partial separator rollers 63A,B, etc. Pressure at 59A is normally held essentially constant to effect partial separation along the lines of perforation within the series of bags, as previously shown in FIG. 2A by segment AB for example. Total separator mechanism 60 is periodically pressed against lower roll 57 from a relaxed position, as shown at arrow 60A. Thus, according to a conventional counting device (not shown) total separator mechanism 60 is actuated at periodic intervals to totally separate a multibag unit from the series of bags passing through separator 50, for example every third bag as shown in FIG. 2B, as caused by total separator rollers 64A,B being urged into nipping contact with lower roller 57 thereby extending the line of nip across the width of the feed series of bags to complete the nip. Accordingly, in continuous operation, a supply of multibag units will rapidly build up from the exit of the nip of second roll set 55 as generally indicated at 56. This supply may then be imbricated on carrier tape by conventional methods. Preferably, spacing 61 between first roll set 51 and second roll set 55 of separator 50 is spaced less than or equal to about two times the bag width in the feed series of bags, so that only one line of perforation is present within spacing 61 at any given moment during operation.

Although the present invention has been described in conjunction with preferred embodiments, it is to be understood that modifications and variations may be utilized without departing from the principles and scope of the invention, as those skilled in the art will readily understand. Accordingly, such modifications and variations may be practiced within the scope of the following claims.

What is claimed is:

1. A method for making a supply of partially separated multibag units, comprising:

(a) passing a perforated chain of side-sealed bags through a first set of driven nip rollers; then (b) passing said chain directly to a second set of nip rollers, having a partial nip of selected width less than the width of said chain; while (c) driving said second nip rollers at a speed greater than said first nip rollers sufficient to partially separate the bags at their respective lines of perforation; and while (d) cyclically completing the nip of said second nip rollers at predetermined intervals corresponding to the number of bags desired in each multibag unit.

2. The method of claim 1, further comprising spacing said second nip rollers up-course of said first set of nip rollers by a distance equal to or less than about 2 bag widths.

3. The method of claim 1, further comprising setting said partial nip within the interior of the width of said bag chain.

4. The method of claim 1, further comprising setting said partial nip to begin at an edge of said bag chain.

5. A method for making a supply of partially separated multibag units, comprising:

(a) passing a perforated chain of side-sealed bags through a first set of driven nip rollers; then (b) passing said chain directly to a second set of nip rollers, having a partial nip of selected width being symmetric widthwise of said bag chain and extending less than the width of said chain and spaced up-course from said first set of nip rollers by a distance equal to or less than about 2 bag widths; while (c) driving said second nip rollers at a speed greater than said first nip rollers sufficient to partially separate the bags at their respective lines of perforation; and while (d) cyclically completing the nip of said second nip rollers at predetermined intervals corresponding to the number of bags desired in each multibag unit.

6. An apparatus for making a supply of partially separated multibag units, comprising:

(a) means for passing a perforated chain of side-sealed bags through a first set of driven nip rollers;

(b) means for passing said chain directly to a second set of nip rollers, having a partial nip of selected width less than the width of said chain;

(c) means for driving said second nip rollers at a speed greater than said first nip rollers sufficient to partially separate the bags at their respective lines of perforation; and (d) means for cyclically completing the nip of said second nip rollers at predetermined intervals corresponding to the number of bags desired in each multibag unit.

7. Apparatus as in claim 6, further comprising means for adjusting the up-course spacing of said second set of nip rollers from said first set of nip rollers.

8. Apparatus as in claim 6, further comprising means for counting bags in association with said means of element (d).

9. Apparatus as in claim 6, further comprising means for adjusting the lateral extent of and location of said partial nip width-wise of said bag chain.

* * * * *